US010692418B2

(12) United States Patent
Seo et al.

(10) Patent No.: US 10,692,418 B2
(45) Date of Patent: Jun. 23, 2020

(54) LOW POWER DRIVING SYSTEM AND TIMING CONTROLLER DISPLAY APPARATUS

(71) Applicant: SILICON WORKS CO., LTD., Daejeon-si (KR)

(72) Inventors: Nam Seok Seo, Daejeon-si (KR); Young Kwang Kim, Gwangmyeong-si (KR); Young Bok Kim, Daejeon-si (KR); Hyun Mo Yang, Daejeon-si (KR); Hae Won Lee, Seoul (KR); Ju Ho Lee, Daejeon (KR)

(73) Assignee: Silicon Works Co., Ltd., Daejeon-si (KR)

( * ) Notice: Subject to any disclaimer, the term of this patent is extended or adjusted under 35 U.S.C. 154(b) by 36 days.

(21) Appl. No.: 16/051,860

(22) Filed: Aug. 1, 2018

(65) Prior Publication Data

US 2019/0043409 A1 Feb. 7, 2019

(30) Foreign Application Priority Data

Aug. 4, 2017 (KR) ..... 10-2017-0099241
Jul. 13, 2018 (KR) ..... 10-2018-0081415

(51) Int. Cl.

| | |
|---|---|
| ***G09G 3/02*** | (2006.01) |
| ***G09G 3/20*** | (2006.01) |
| *G09G 3/3275* | (2016.01) |
| *G09G 3/36* | (2006.01) |

(52) U.S. Cl.

CPC ..... *G09G 3/2003* (2013.01); *G09G 3/3275* (2013.01); *G09G 3/3688* (2013.01); *G09G 2310/0248* (2013.01); *G09G 2310/0291* (2013.01); *G09G 2310/08* (2013.01); *G09G 2320/103* (2013.01); *G09G 2330/021* (2013.01)

(58) Field of Classification Search

CPC ..... G09G 2310/0248; G09G 2310/08; G09G 2320/103; G09G 2330/021; G09G 3/2003; G09G 3/3275; G09G 3/3688
USPC ..... 345/204
See application file for complete search history.

(56) References Cited

U.S. PATENT DOCUMENTS

2008/0055318 A1* 3/2008 Glen ..... G09G 3/20 345/501
2009/0207118 A1 8/2009 Lee et al.
(Continued)

FOREIGN PATENT DOCUMENTS

KR 10-1337497 12/2013

*Primary Examiner* — Tony O Davis
(74) *Attorney, Agent, or Firm* — Polsinelli PC

(57) ABSTRACT

The present invention discloses a low power driving system and timing controller for a display apparatus. The low power driving system may include: a timing controller configured to divide a display pattern into a static pattern and a dynamic pattern based on a difference between previous line data and current line data, and transmit a packet into which one of first option information corresponding to the static pattern and second option information corresponding to the dynamic pattern is applied; and a source driver configured to receive the packet, and perform a low power mode corresponding to the static pattern according to the first option information or perform adaptive charge sharing corresponding to the dynamic pattern according to the second option information.

15 Claims, 10 Drawing Sheets

(56) References Cited

U.S. PATENT DOCUMENTS

| | | | | |
|---|---|---|---|---|
| 2013/0187897 | A1* | 7/2013 | Liu | G09G 3/3648 345/204 |
| 2014/0320464 | A1* | 10/2014 | Ryu | G09G 3/3688 345/204 |
| 2015/0103065 | A1 | 4/2015 | Kim et al. | |
| 2016/0035301 | A1 | 2/2016 | Neugebauer | |
| 2017/0169763 | A1* | 6/2017 | Bi | G09G 5/003 |
| 2018/0218667 | A1* | 8/2018 | Yamazumi | G09G 3/2096 |

* cited by examiner

LOW POWER DRIVING SYSTEM AND TIMING CONTROLLER DISPLAY APPARATUS

BACKGROUND

1. Technical Field

The present disclosure relates to a low power driving technology, and more particularly, to a low power driving system and timing controller for a display device.

2. Related Art

A display device includes a timing controller, a source driver and a display panel. The timing controller may be designed to provide display data, control data and clock as a packet to the source driver. The source driver receives the display data, and provides a source signal corresponding to the display data to the display panel. The display panel displays a screen corresponding to the source signal.

The display device requires a technique for reducing power consumption in various elements. In particular, various attempts have been made to reduce power consumption at the level of the timing controller and the source driver.

SUMMARY

Various embodiments are directed to a low power driving system and timing controller for a display apparatus, which can recognize a display pattern, and transfer option information including information on the recognized display pattern to a source driver, thereby reducing power consumption of the source driver.

Also, various embodiments are directed to a low power driving system for a display apparatus, which can provide a packet including option information for reducing power consumption in response to a display pattern, and perform charge sharing control on an output according to the option information or perform current control on one or more of an output buffer, gamma buffer and intermediate driving voltage buffer, thereby reducing power consumption.

In an embodiment, a low power driving system for a display apparatus may include: a timing controller configured to divide a display pattern into a static pattern and a dynamic pattern based on a difference between previous line data and current line data, and transmit a packet into which one of first option information corresponding to the static pattern and second option information corresponding to the dynamic pattern is applied; and a source driver configured to receive the packet, and perform a low power mode corresponding to the static pattern according to the first option information or an adaptive charge sharing corresponding to the dynamic pattern according to the second option information.

In another embodiment, a timing controller for a display apparatus may include: a pixel value storage unit configured to store previous line data and current line data, and provide the previous line data and the current line data for mapping; an operation unit configured to calculate a power gain and power loss by charge sharing on the current line data according to a comparison result between the previous line data and the current line data, or calculate a first maximum variation of a source driver output in the case where charge sharing is applied to the current line data and a second maximum variation of the source driver output in the case where charge sharing is not applied to the current line data; and an option providing unit configured to provide second option information on whether to apply charge sharing to the current line data by referring to whether charge sharing was applied to the previous line data and a comparison result between the power gain and the power loss when a display pattern is a dynamic pattern, and provide one of the first and second maximum variations, selected according to whether charge sharing was applied to the previous line data, as first option information when the display pattern is a static pattern.

DETAILED DESCRIPTION

Figure 1:
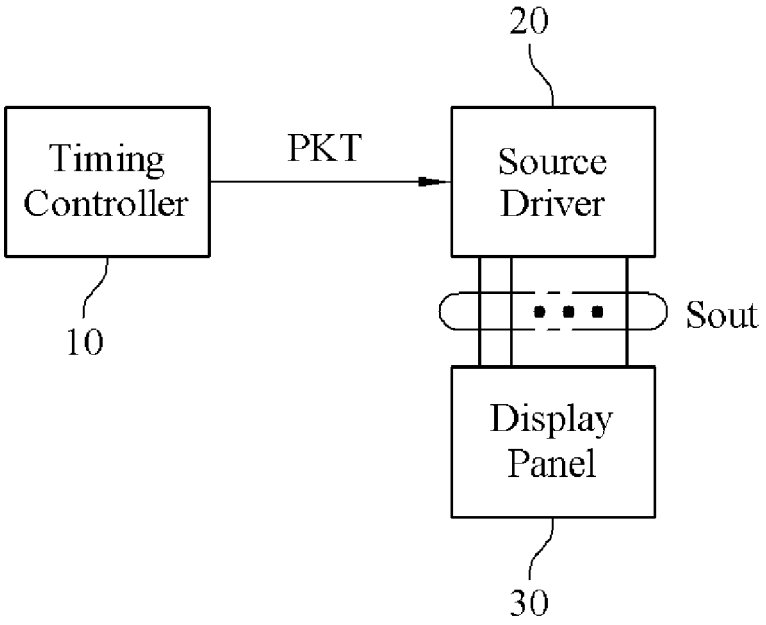
FIG. 1 is a block diagram illustrating a low power driving system for a display device in accordance with an embodiment of the present invention.

Hereafter, embodiments of the present invention will be described in detail with reference to the accompanying drawings. The terms used in the present specification and claims are not limited to typical dictionary definitions, but must be interpreted as meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 illustrates a low power driving system for a display device in accordance with an embodiment of the present invention.

Referring to FIG. 1, the low power driving system includes a timing controller 10, a source driver 20 and a display panel 30.

The timing controller 10 generates a packet PKT using display data received from outside, and provides the packet PKT to the source driver 20.

The packet PKT generated by the timing controller 10 may include the display data and control data, and the control data may include various pieces of option information for distinguishing a power control mode.

The power control mode may be divided into a low power mode control operation and an adaptive charge sharing control operation. The option information may indicate the low power mode control or adaptive charge sharing control, and have a value based on a preset protocol. Furthermore, the option information may be included in the control data, and thus applied to the packet PKT.

The source driver 20 may receive the packet PKT from the timing controller 10, and output a source signal Sout corresponding to the display data to the display panel 30. The source driver 20 may be configured to perform a power control mode corresponding to the option information of the control data during a process of converting the display data into the source signal Sout and a process of outputting the source signal Sout.

The source driver 20 may include a latch, shift register, digital-analog converter and output buffer, in order to convert the display data. The source driver 20 may further include a gamma buffer for providing a gamma voltage to the digital-analog converter and an intermediate driving voltage (HVDD) buffer for providing a driving voltage to the output buffer.

Since the latch, the shift register, the digital-analog converter, the output buffer, the gamma buffer and the intermediate driving voltage buffer are components which are typically used in the source driver 20, the detailed illustrations and descriptions thereof are omitted herein.

The display panel 30 may be implemented with a flat display panel. For example, a display panel including pixels using an organic light emitting diode (OLED), light emitting diode (LED) or liquid crystal panel (LCD) may be used as the display panel 30.

In the configuration of FIG. 1, the low power driving system for a display device in accordance with the embodiment of the present invention includes the timing controller 10 and the source driver 20.

Figure 2:
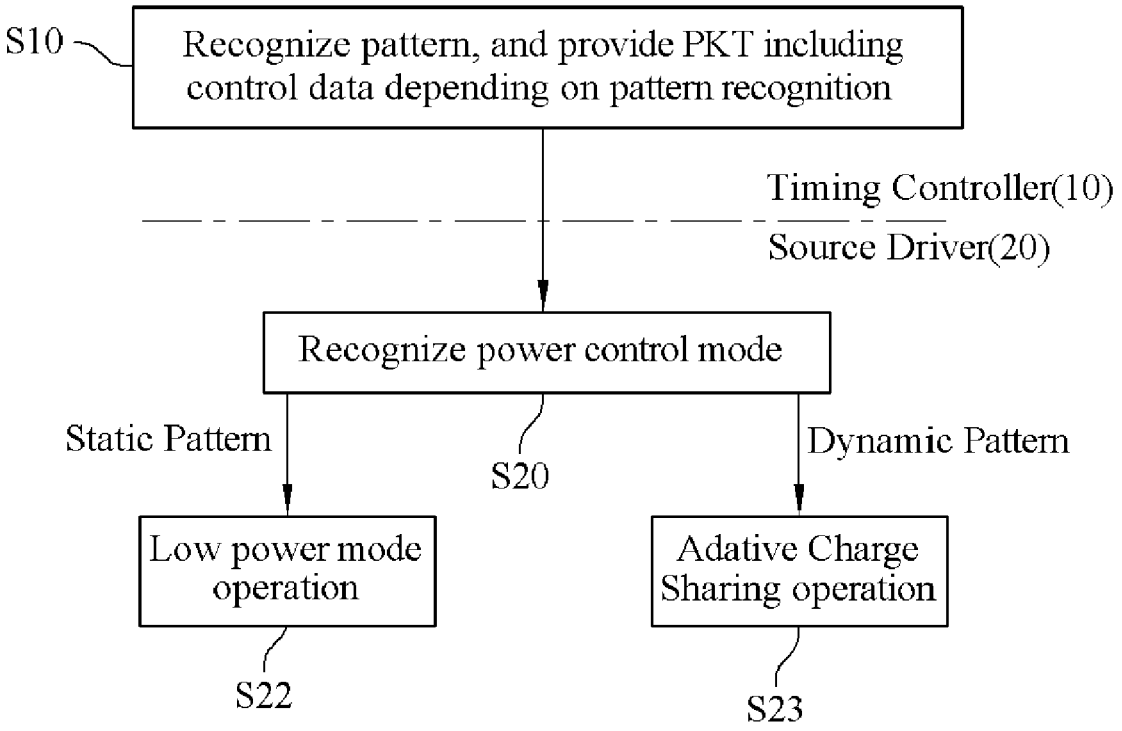
FIG. 2 is a flowchart illustrating a low power driving method in accordance with the embodiment of FIG. 1.

The operation of the low power driving system for a display device will be described with reference to FIG. 2.

First, the timing controller 10 divides a display pattern into a static pattern and a dynamic pattern based on a difference between previous line data and current line data, and transmits a packet PKT to which one of first option information corresponding to the static pattern and second option information corresponding to the dynamic pattern is applied.

The timing controller 10 performs a control process, and the control process may include step S10 of performing pattern recognition and providing the packet PKT which contains control data having the first or second option information based on the pattern recognition.

The source driver 20 may receive the packet PKT, and recognize the power control mode according to the first or second option information. More specifically, the source driver 20 performs the low power mode operation corresponding to the static information according to the first option information, or performs the adaptive charge sharing operation corresponding to the dynamic pattern according to the second option information.

That is, the source driver 20 performs a driving process according to the power control mode recognition, and the driving process includes step S20 of recognizing the power control mode according to the display pattern, step S22 of performing the low power mode operation when the display pattern is a static pattern, and step S23 of performing the adaptive charge sharing operation when the display pattern is a dynamic pattern.

The display pattern may be determined to be one of the static pattern and the dynamic pattern through an operation of comparing the previous line data and the current line data.

At this time, the determination criterion for distinguishing between the static pattern and the dynamic pattern may be set to a data variation between the previous line data and the current line data, and the reference value of the data variation for determining between the static pattern and the dynamic pattern set to various values depending on a designer's intention.

The static pattern may indicate that the source signals Sout corresponding to outputs of the source driver 20 are constantly retained because the data variation between the previous line data and the current line data is small.

The dynamic pattern may indicate that the source signals Sout corresponding to outputs of the source driver 20 are swung because the data variation between the previous line data and the current line data is large.

In the present embodiment, when the display pattern is the static pattern, the timing controller 10 provides the first option information for judging the power control mode as the low power mode control operation, and the source driver 20 performs the low power mode in response to the first option information, in order to reduce power consumption by reducing the amount of current for retaining the output of the current line data.

On the other hand, when the display pattern is the dynamic pattern, the timing controller 10 provides the second option information for judging the power control mode as the adaptive charge sharing operation, and the source driver 20 performs the adaptive charge sharing operation for reducing power consumption in response to the second operation information. Specifically, the source driver 20 performs charge sharing on the output of the current line data, and provides a current discharged from a load capacitor of the display panel to where current charging is required, thereby reducing power consumption.

Figure 3:
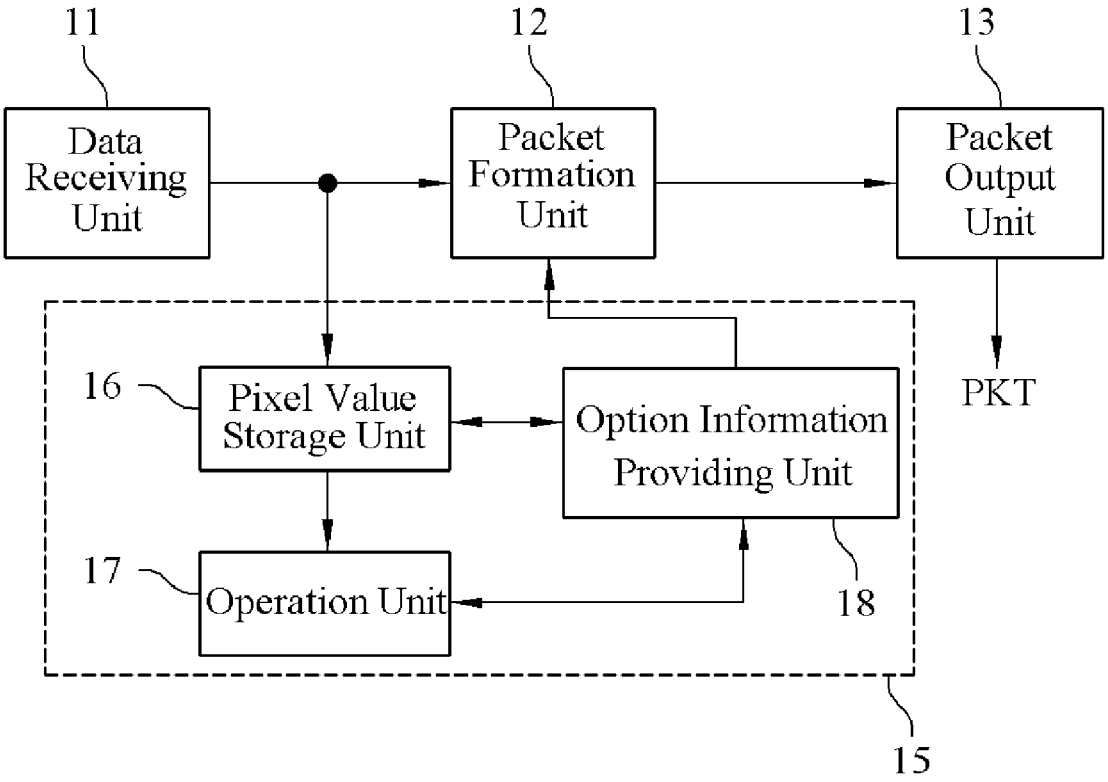
FIG. 3 is a block diagram illustrating the timing controller of FIG. 1.

The timing controller 10 may provide the packet PKT including the first or second option information in the control data, in order to reduce the power consumption of the source driver 20. For this operation, the timing controller 10 may be configured as illustrated in FIG. 3. The second option information may be decided and provided through the adaptive charge sharing control operation of FIG. 4, and the first option information may be decided and provided through the low power mode control operation of FIG. 10. The adaptive charge sharing control operation of FIG. 4 and the low power mode control operation of FIG. 10 may be included in step S10 of performing the pattern recognition and providing the packet PKT containing the control data having the first or second option information based on the pattern recognition.

Referring to FIG. 3, the timing controller 10 includes a data receiving unit 11, a packet formation unit 12, a packet output unit 13 and an option information formation unit 15.

The data receiving unit 11 transfers display data received from outside to the packet formation unit 12. The packet formation unit 12 provides display data, control data and clock for forming a packet PKT as parallel data to the packet output unit 13. The packet output unit 13 converts the parallel data into serial data according to a predetermined protocol, and transmits the serial data as the packet PKT to the source driver 20.

In the above-described configuration, the packet formation unit 12 receives the first or second option information from the option information formation unit 15, and includes the first or second information in the control data.

The option information formation unit 15 compares the previous line data and the current line data, and provides the first or second option information as the comparison result.

For this operation, the option information formation unit 15 includes a pixel value storage unit 16, an operation unit 17 and an option information providing unit 18.

The pixel value storage unit 16 may include a memory for storing display data on a line basis, the display data being transferred to the packet formation unit 12 from the data receiving unit 11. The pixel value storage unit 16 may have a capacity to store at least the previous line data and the current line data while providing the data for mapping. The pixel value storage unit 16 may perform the operation of storing the display data on a line basis and the operation of providing the previous line data and the current line data for mapping, in synchronization with the control and operation of the option information providing unit 18.

The operation unit 17 may perform an operation of receiving the previous line data and the current line data from the pixel value storage unit 16 and mapping the previous line data and the current line data to calculate a data variation between the previous line data and the current line data, an operation of judging the display pattern by referring to the data variation, an operation of calculating a power gain Ps and power loss Pw by charge sharing of the current line data, an operation of comparing the power gain Ps and the power loss Pw, and an operation of detecting the maximum variation Lpeak_cs or Lpeak_ncs of the source driver output when charge sharing is applied to the current line data or when charge sharing is not applied to the current line data. The operation unit 17 may perform an operation selected from the operations according to the display pattern, and provide the operation result to the option information providing unit 18.

The option information providing unit 18 may control the operation unit 17 to select an operation to perform according to the display pattern, receive the operation result to decide option information corresponding to the display pattern, and provide the decided option information to the packet formation unit 12.

Figure 4:
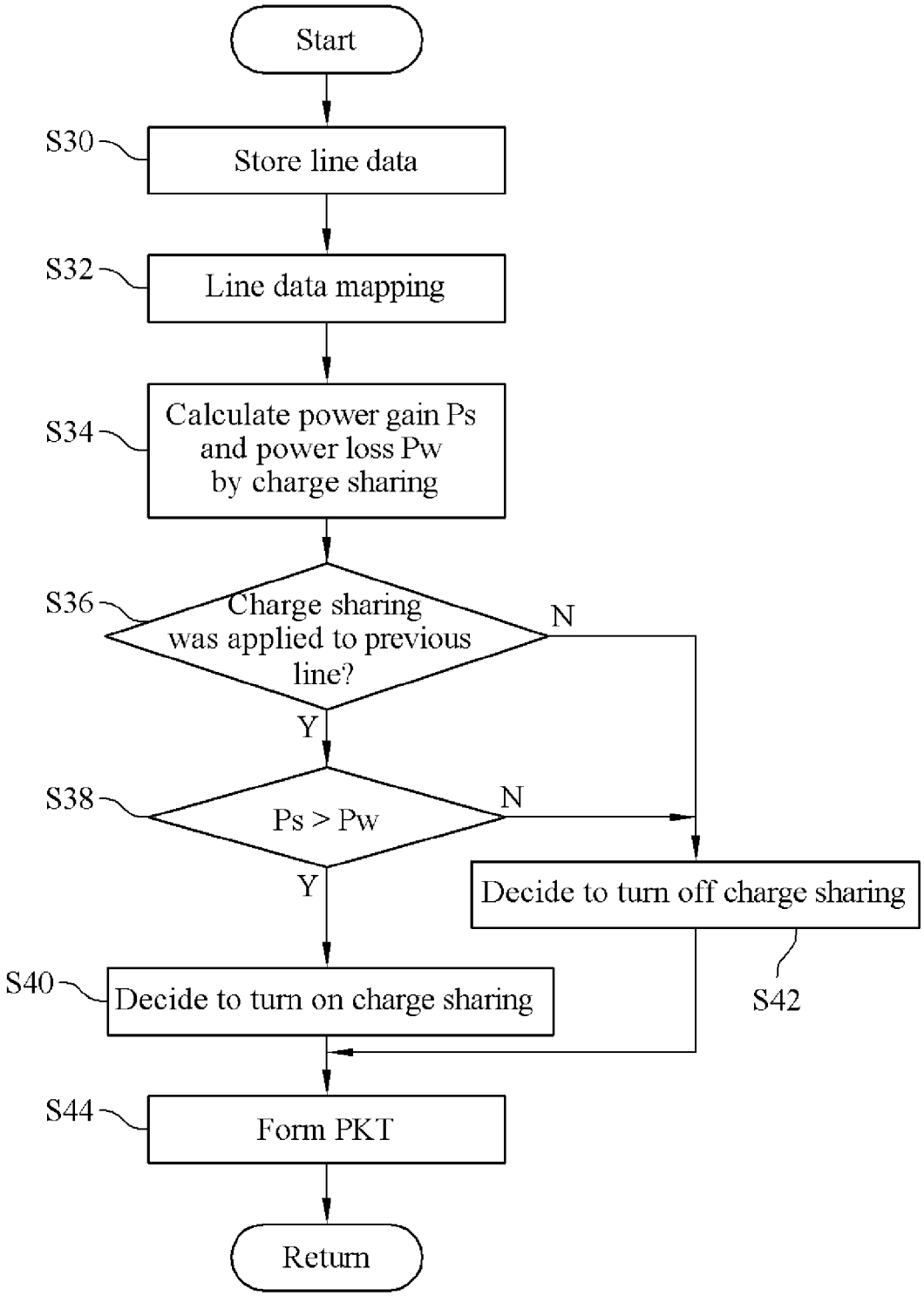
FIG. 4 is a flowchart illustrating an adaptive charge sharing control operation.
Figure 10:
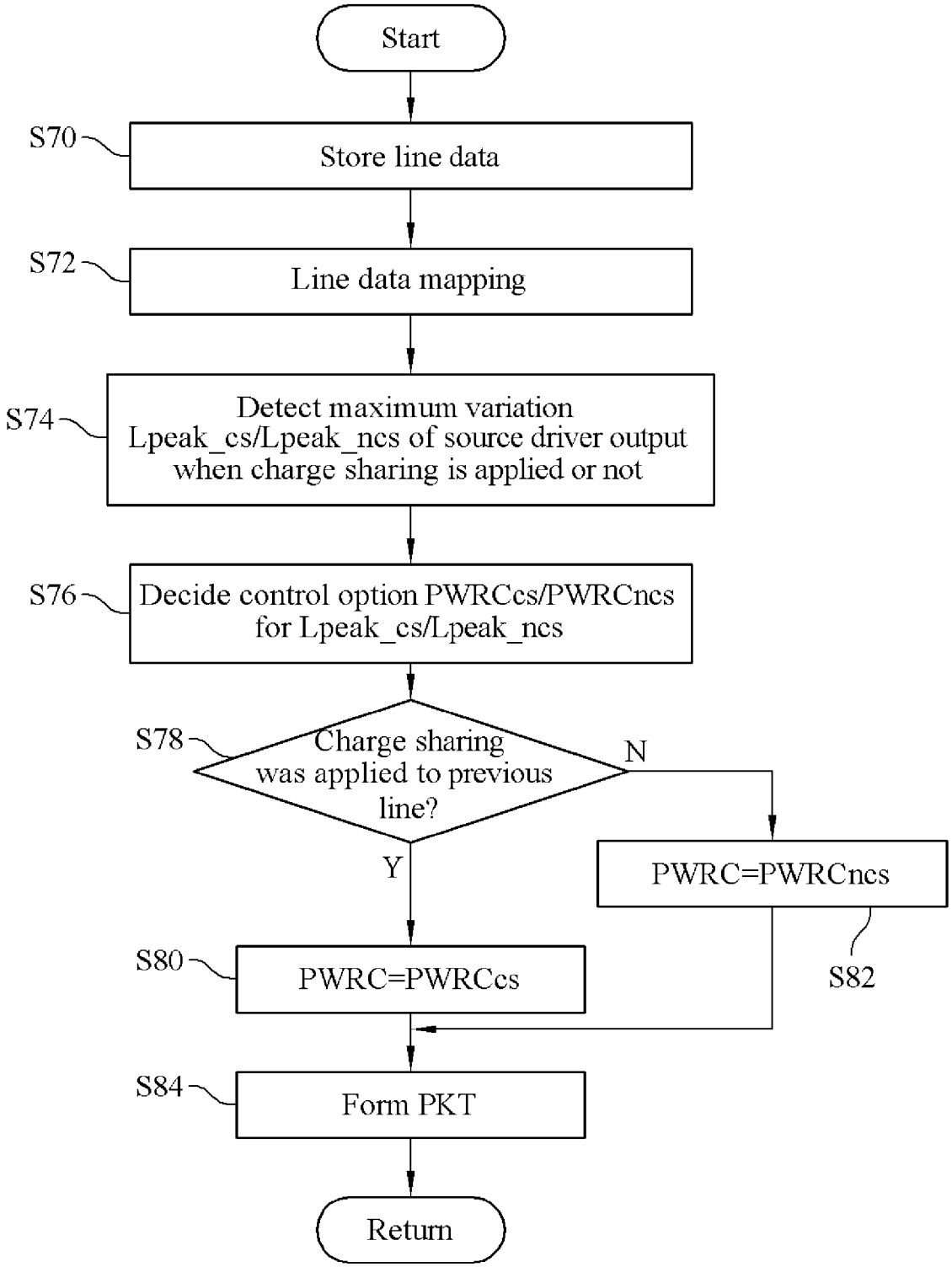
FIG. 10 is a flowchart illustrating a low power mode control operation.

That is, the option information formation unit 15 may decide the second option information obtained through the adaptive charge sharing operation of FIG. 4 or the first option information obtained through the low power mode control operation of FIG. 10, and provide the decided first or second option information to the packet formation unit 12.

The adaptive charge sharing operation of FIG. 4 is performed when the display pattern corresponds to the dynamic pattern.

The adaptive charge sharing operation may be simply summarized as follows. The adaptive charge sharing operation includes mapping and comparing the previous line data and the current line data, calculating the power gain Ps and power loss Pw by charge sharing for the current line data, and decides whether to apply charge sharing to the current line data by referring to a comparison result between the power gain Ps and the power loss Pw and whether charge sharing was applied to the previous line data.

That is, the second option information obtained by the adaptive charge sharing control operation may be understood as information indicating whether to apply charge sharing to a source signal corresponding to the current line data.

The low power mode control operation of FIG. 10 is performed when the display pattern corresponds to the static pattern.

The low power mode control operation may be simply summarized as follows. The low power mode control operation includes mapping and comparing the previous line data and the current line data, detecting a first maximum variation of the source driver output in the case where charge sharing is applied to the current line data, and selecting the first maximum variation as a first option level. Furthermore, the low power mode control operation includes mapping and comparing the previous line data and the current line data, detecting a second maximum variation of the source driver output in the case where charge sharing is not applied to the current line data, and selecting the second maximum variation as a second option level.

Then, according to whether charge sharing was applied to the previous line data, one of the first and second option levels is selected as the first option information to apply to the packet.

The adaptive charge sharing control operation will be described in detail with reference to FIG. 4.

First, when the display pattern is the dynamic pattern, the timing controller 10 stores the previous line data N−1 Line and the current line data N Line in the pixel value storage unit 16 in order to decide whether to apply charge sharing, at step S30, and the operation unit 17 maps the previous line data N−1 Line and the current line data N Line to each other at step S32.

Figure 5:
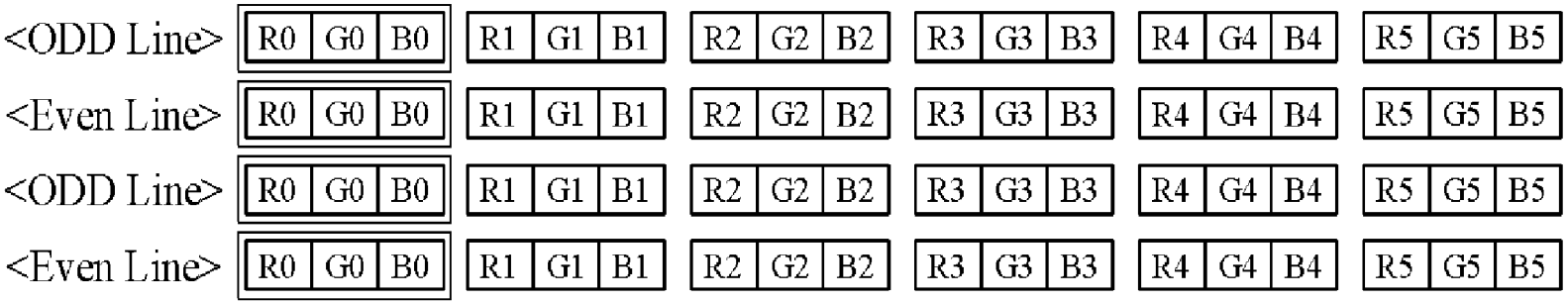
FIGS. 5 and 6 illustrate a panel structure.
Figure 6:
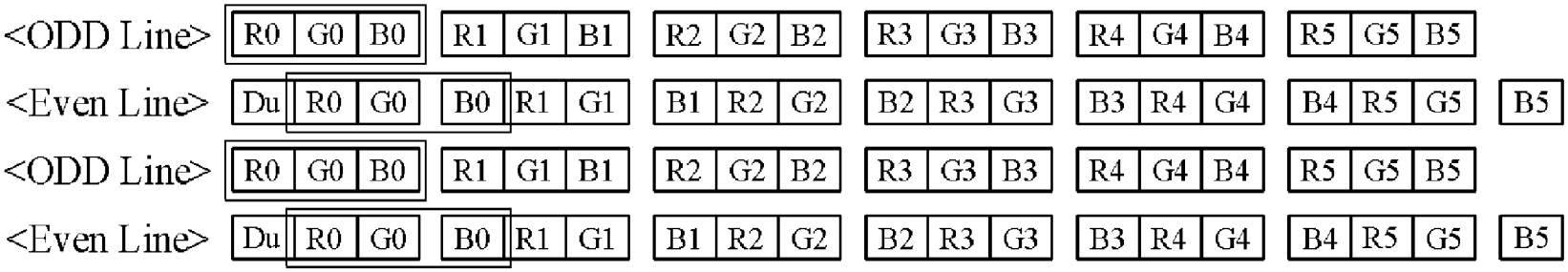

The display panel 30 includes pixels configured in different forms depending on the type thereof. FIG. 5 illustrates an arrangement of the pixels of the display panel 30 configured in a normal type, and FIG. 6 illustrates an arrangement of the pixels of the display panel 30 configured in a Z-inversion type. In FIGS. 5 and 6, Rx pixels indicate red pixels, Bx pixels indicate blue pixels, Gx pixels indicate green pixels, and Du pixels indicate dummy pixels.

The timing controller 10 may form the packet PKT by sorting the display data through the arrangement of red pixels, blue pixels and green pixels on a line basis, which differs depending on the type of the display panel 30.

Therefore, the timing controller 10 calls information for checking the specification of the display panel 30 to compare the previous line data N−1 Line and the current line data N Line, and perform the mapping to resort the previous line data N−1 Line and the current line data N Line depending on the specification of the display panel 30.

Then, the timing controller 10 compares the previous line data and the current line data through the operation unit 17, and calculates the power gain Ps and the power loss Pw which are caused by the charge sharing for the current line data, at step S34. The power gain Ps and the power loss Pw may be calculated through an expression which is previously set in the timing controller 10.

Figure 7:
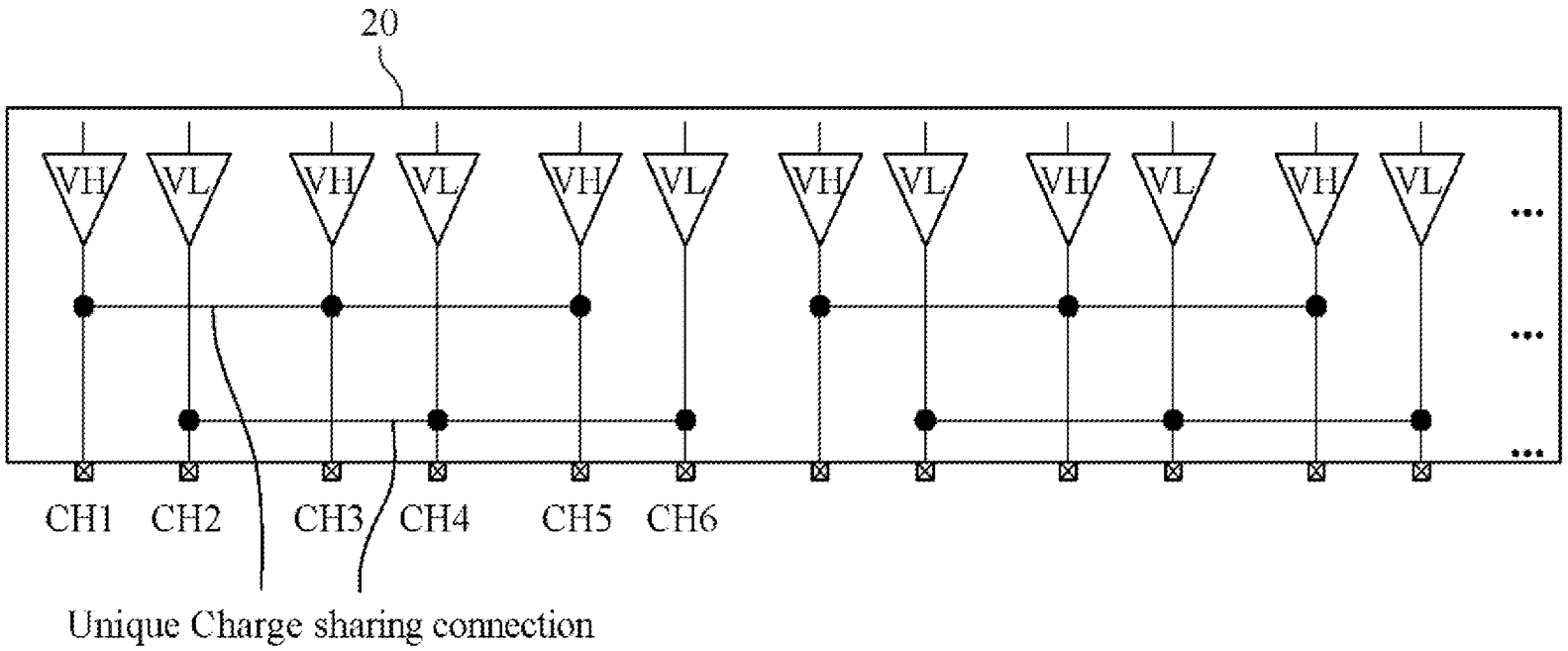
FIG. 7 is a block diagram for describing unique charge sharing applied to the present invention.

The source driver 20 in accordance with the embodiment of the present invention may perform charge sharing on the entire channels through unique charge sharing of FIG. 7. The source driver 20 has a plurality of channels for outputting the source signal Sout. The unique charge sharing indicates that the entire channels are divided into a predetermined number of groups, and charge sharing is performed on each of the groups. In FIG. 7, the channels for charge sharing may be switched through a plurality of MOS transistors, and the plurality of MOS transistors may be implemented in various manners depending on a designer's intention. Therefore, the detailed descriptions thereof are omitted herein.

FIG. 7 illustrates that six channels CH1 to CH6 are grouped as a unique structure. In this case, among the six channels CH1 to CH6, high output buffers VH may be connected for charge sharing, and low output buffers VL may be connected for charge sharing. In the unique structure, the charge sharing voltage may be set to a level corresponding to the average of the connected channels.

Figure 8:
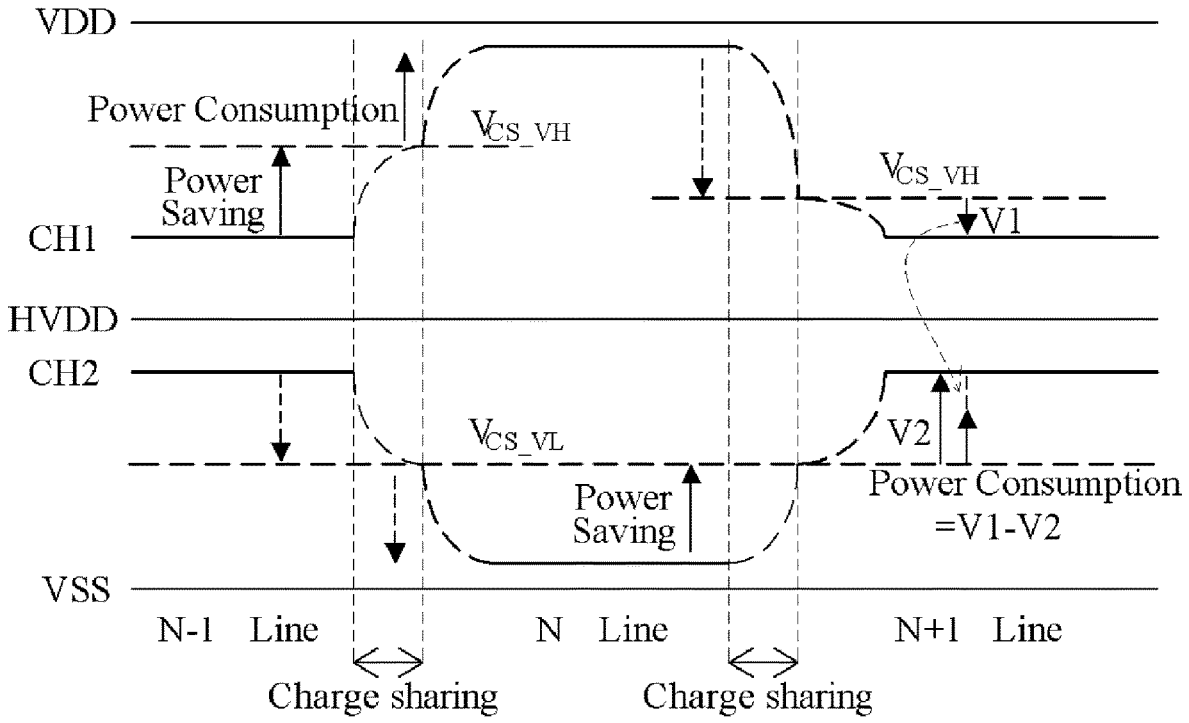
FIGS. 8 and 9 are waveform diagrams for describing power saving and power consumption by charge sharing.
Figure 9:
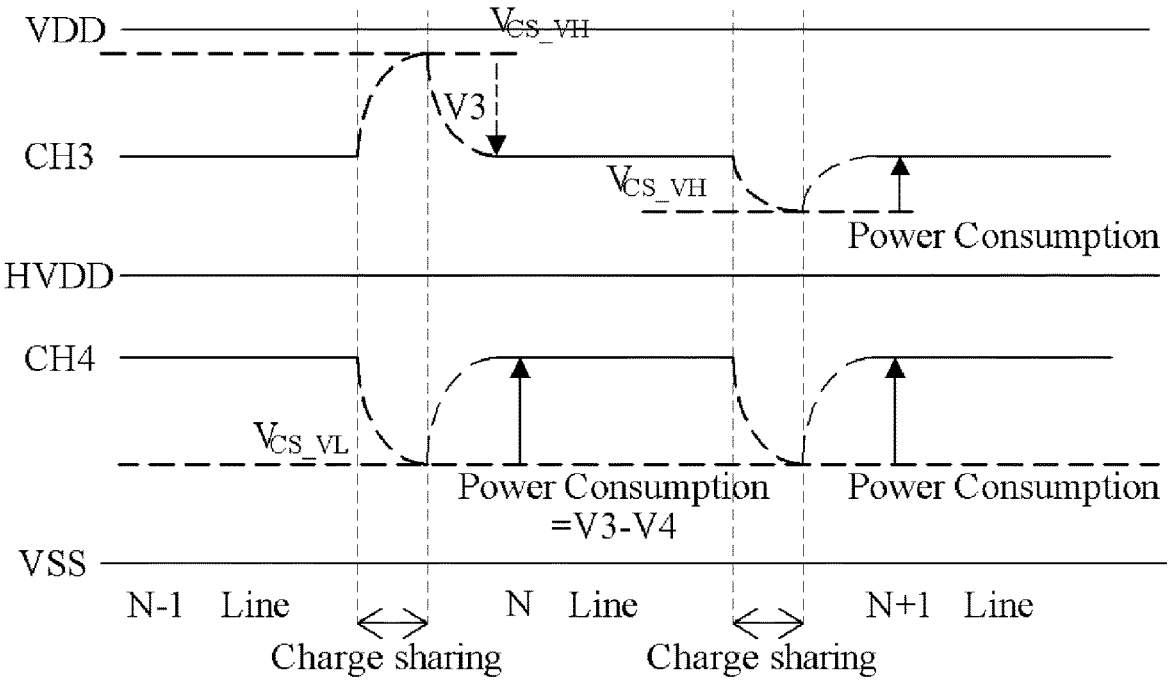

Referring to FIGS. 8 and 9, the channels have a polarity which is changed on the basis of the intermediate driving voltage HVDD, and performs charge sharing while being driven on a line basis.

The high output buffer VH may drive an output in the range of the intermediate driving voltage VHDD and the driving voltage VDD, and the low output buffer VL may drive an output in the range of the ground voltage VSS and the intermediate driving voltage HVDD. At this time, the intermediate driving voltage HVDD may be set to a voltage having a level corresponding to ½ of the range between the driving voltage VDD and the ground voltage VSS. The charge sharing voltage $V_{cs_VH}$ for the high output buffer VH may be set to a level between the intermediate driving voltage HVDD and the driving voltage VDD, and the charge sharing voltage VCS_VL for the low output buffer VL may be set to a level between the intermediate driving voltage HVDD and the ground voltage VSS.

The channels may repeat driving and charge sharing in response to pixel data which are changed on a line basis.

While the driving and the charge sharing are repeated, power saving and power consumption may be achieved according to voltage changes of the channels.

From the viewpoint of power consumption, a reduction of the voltage level may indicate that the display panel, i.e. the load capacitor is discharged. In this case, it may be understood that no power is consumed.

However, when the voltage level rises to the charge sharing level VCS_VH or VCS_VL, it may indicate that charging is performed by a discharge current. In this case, power saving may be achieved. That is, the power saving may be used for calculating the power gain Ps caused by the charge sharing.

Furthermore, when the voltage level rises from the charge sharing level VCS_VH or VCS_VL, it may indicate that power is consumed. In this case, the power consumption may be used for calculating the power loss Pw caused by the charge sharing.

The timing controller 10 controls the operation unit 17 to compare the previous line data and the current line data for the entire channels connected through the unique charge sharing, and to calculate the power gain Ps and the power loss Pw which are caused by the charge sharing for the current line data, at step S34.

When the power gain Ps and the power loss Pw are calculated, the option information providing unit 18 of the timing controller 10 checks whether charge sharing was applied to the previous line data, at step S36, and checks whether the power gain Ps is larger than the power loss Pw, through the operation of the operation unit 17, at step S38.

For example, step S38 of checking whether the power gain Ps is larger than the power loss Pw may include determining whether the power gain Ps is larger by a preset offset level or more than the power loss Pw.

When charge sharing was not applied to the previous line data or the power gain Ps is smaller than the power loss Pw, the option information providing unit 18 of the timing controller 10 determines not to apply charge sharing to the current line data, and turns off the charge sharing at step S42. In this case, the option information providing unit 18 defines the corresponding second option information, and provides the defined second option information to the packet formation unit 12. Therefore, the packet formation unit 12 forms the packet PKT to which the second option information is applied, the second option information indicating that charge sharing is not applied to the current line data, at step S44.

On the other hand, when charge sharing was applied to the previous line data or the power gain Ps is larger than the power loss Pw, the option information providing unit 18 of the timing controller 10 determines to apply charge sharing to the current line data, and turns on the charge sharing at step S40. In this case, the option information providing unit 18 defines the corresponding second option information, and provides the defined second option information to the packet formation unit 12. Therefore, the packet formation unit 12 forms the packet PKT to which the second option information is applied, the second option information indicating that charge sharing is applied to the current line data, at step S44.

When the display pattern is the dynamic pattern, the timing controller 10 may generate the second option information on whether to apply charge sharing to the source signal corresponding to the current line data through the adaptive charge sharing control process of FIG. 4, and provide the packet PKT including the second option information to the source driver 20.

The source driver 20 may perform adaptive charge sharing on the source signal, in order to reduce power consumption in response to the second option information indicating that the charge sharing is applied, or normally output the source signal without adaptive charge sharing, in response to the second option information indicating that the charge sharing is not applied.

The low power mode control operation will be described in detail with reference to FIG. 10.

The timing controller 10 may control the amount of current for the output of the source driver 20 when the display pattern is the static pattern, in order to perform the low power mode control operation for reducing power consumption as illustrated in FIG. 10.

When the display pattern is the static pattern, the timing controller 10 performs the low-power mode control process of checking an output variation of the source driver 20 with respect to the current line data, and deciding the first option information suitable for the maximum variation.

Figure 11:
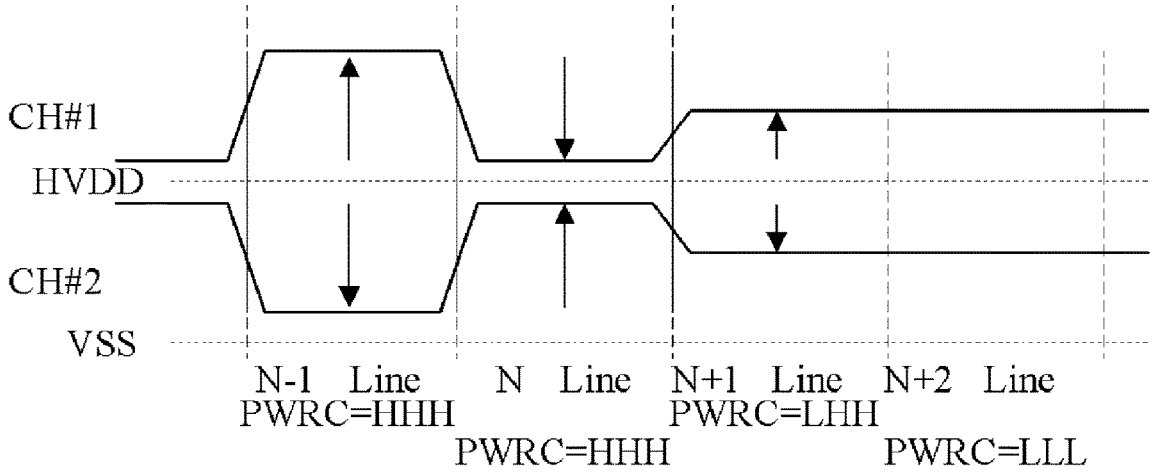
FIG. 11 is a waveform diagram for describing the low power mode control operation depending on the output level of a source driver.

Referring to FIG. 11, the first option information may be represented by PWRC, and changed to "HHH", "LHH" or "LLL".

The first option information may be configured to control the amount of current in such a range that can retain the output of the source driver 20 in response to the line data of the static pattern.

Figure 12:
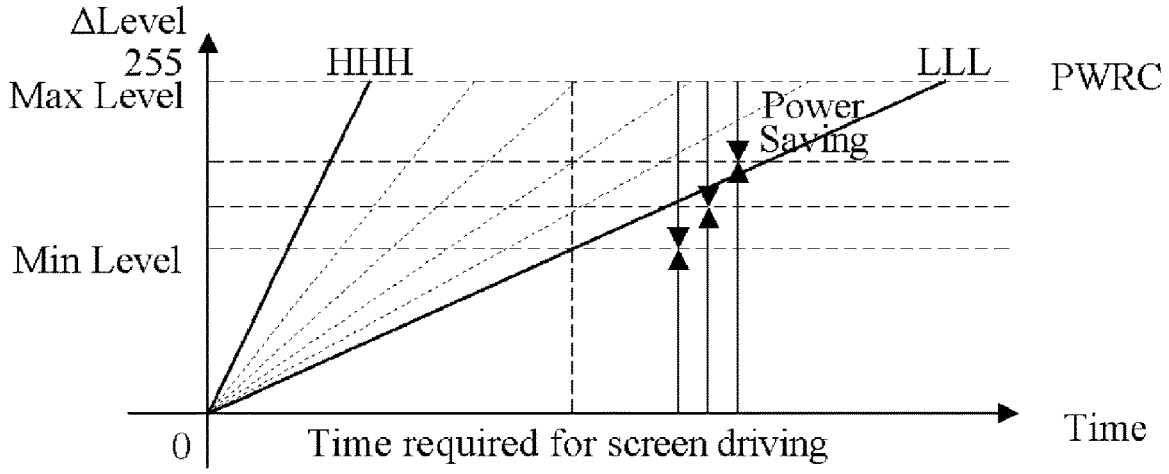
FIG. 12 is a graph illustrating an output change slope of the source driver depending on time, corresponding to option information.

As illustrated in FIG. 12, the first option information may be included in such a range that satisfies the minimum level and the time required for driving a screen, and set on a line data basis in order to reduce the current amount. That is, the first option information may be decided in response to the current line data, in order to reduce the current amount in such a range that retains the output voltage in response to the previous line data.

For this configuration, the timing controller 10 compares the previous line data and the current line data, stored in the pixel value storage unit 16, through the operation unit 17.

The operation unit 17 of the timing controller 10 compares the previous line data and the current line data, and detects the first maximum variation Lpeak_cs of the output of the source driver 20 as an absolute value in the case where charge sharing is applied to the current line data. Furthermore, the operation unit 17 compares the previous line data and the current line data, and detects the second maximum variation Lpeak_cs of the output of the source driver 20 as an absolute value in the case where charge sharing is not applied to the current line data, at step S74. At this time, the first and second maximum variations Lpeak_cs and Lpeak_ncs may be stored as the largest value among the values of the entire channels connected through the unique charge sharing.

The operation unit 17 of the timing controller 10 selects the first and second maximum variations Lpeak_cs and Lpeak_ncs as the first and second option levels, respectively, and decides control options PWRCcs and PWRCncs corresponding to the first and second option levels, at step S76.

Then, the option information providing unit 18 of the timing controller 10 checks whether charge sharing was applied to the previous line data, at step S78.

When charge sharing was applied to the previous line data, the option information providing unit 18 of the timing controller 10 may select the control option PWRCcs as the first option information PWRC at step S80, and provide the first option information PWRC to the packet formation unit 12, and the packet PKT may be formed by applying the first option information PWRC at step S84. On the other hand, when charge sharing was not applied to the previous line data, the option information providing unit 18 of the timing controller 10 may select the control option PWRCncs as the first option information PWRC at step S82, and provide the first option information PWRC to the packet formation unit 12, and the packet PKT may be formed by applying the first option information PWRC at step S84.

Through the low power mode control operation, the timing controller 10 performs control for reducing power consumption by controlling the amount of current for the output of the source driver 20 when the display pattern is the static pattern.

The timing controller 10 can reduce the power consumption of the source driver 20 while performing the adaptive charge sharing control operation of FIG. 3 and the low power mode control operation of FIG. 10 on a line data basis.

The timing controller 10 may perform the above-described low power mode control process in consideration of the output buffer, the gamma buffer and the intermediate driving voltage buffer, generate separate option information for controlling the output buffer, the gamma buffer and the intermediate driving voltage buffer, and apply the option information to the packet PKT.

Therefore, the source driver 20 may control the output buffer, the gamma buffer and the intermediate driving voltage buffer in response to the respective pieces of option information, thereby reducing the entire current consumption.

Through the above-described configuration and operation, the timing controller 10 can recognize the display pattern, and transfer the option information corresponding to the recognition of the display pattern to the source driver 20, thereby reducing the power consumption of the source driver 20.

Furthermore, according to the option information corresponding display pattern, the timing controller 10 can perform charge sharing control on the output of the source driver 20 or perform current control on one or more of the output buffer, the gamma buffer and the intermediate driving voltage buffer, thereby reducing power consumption.

While various embodiments have been described above, it will be understood to those skilled in the art that the embodiments described are by way of example only. Accordingly, the disclosure described herein should not be limited based on the described embodiments.

What is claimed is:

1. A low power driving system for a display apparatus, comprising:

a timing controller configured to divide a display pattern into a static pattern and a dynamic pattern based on a difference between previous line data and current line data, and transmit a packet into which one of first option information corresponding to the static pattern and second option information corresponding to the dynamic pattern is applied; and a source driver configured to receive the packet, and perform a low power mode corresponding to the static pattern according to the first option information or an adaptive charge sharing corresponding to the dynamic pattern according to the second option information, wherein the timing controller calculates a first maximum variation of the source driver output in the case where charge sharing is applied to the current line data and a second maximum variation of the source driver output in the case where charge sharing is not applied to the current line data, in response to the comparison result between the previous line data and the current line data, and provides one of the first and second maximum variations, selected according to whether charge sharing was applied to the previous line data, as the first option information.

2. The low power driving system of claim 1, wherein the timing controller controls the adaptive charge sharing of the source driver by providing the second option information to the source driver through the packet in response to a comparison result between the previous line data and the current line data, the second information indicating whether to apply charge sharing to the current line data.

3. The low power driving system of claim 2, wherein the timing controller calculates a power gain and power loss by charge sharing on the current line data according to the comparison result between the previous line data and the current line data, and provides the second option information on whether to apply charge sharing to the current line data by referring to whether charge sharing was applied to the previous line data and a comparison result between the power gain and the power loss.

4. The low power driving system of claim 3, wherein the timing controller provides the second option information for turning off the charge sharing on the current line data when charge sharing was not applied to the previous line data or the power gain is smaller than the power loss, and provides the second option information for turning on the charge sharing on the current line data when charge sharing was applied to the previous line data and the power gain is larger than the power loss.

5. The low power driving system of claim 3, wherein the timing controller calculates the power gain and the power loss by the charge sharing on the current line data by comparing the previous line data and the current line data for the entire channels of the source driver, connected through unique charge sharing.

6. The low power driving system of claim 3, wherein the source driver performs the adaptive charge sharing to selectively perform charge sharing of a source signal on the current line data according to the second option information.

7. The low power driving system of claim 1, wherein the timing controller provides the first maximum variation as the first option information when charge sharing was applied to the previous line data, and provides the second maximum variation as the second option information when charge sharing was not applied to the previous line data.

8. The low power driving system of claim 1, wherein the timing controller stores the largest value among the values of the entire channels connected through unique charge sharing, as the first and second maximum variations.

9. The low power driving system of claim 1, wherein the source driver performs the low power mode to reduce the amount of current for maintaining the output of the current line data based on one of the first and second maximum variations, provided as the first option information.

10. The low power driving system of claim 1, wherein the timing controller provides the first option information including information for distinguishing an output buffer, a gamma buffer and an intermediate driving voltage buffer, and the source driver performs the low power mode on a buffer selected by the first option information, among the output buffer, the gamma buffer and the intermediate driving voltage buffer.

11. A timing controller for a display apparatus, comprising:

a pixel value storage unit configured to store previous line data and current line data, and provide the previous line data and the current line data for mapping;

an operation unit configured to calculate a power gain and power loss by charge sharing on the current line data according to a comparison result between the previous line data and the current line data, or calculate a first maximum variation of a source driver output in the case where charge sharing is applied to the current line data and a second maximum variation of the source driver output in the case where charge sharing is not applied to the current line data; and an option providing unit configured to provide second option information on whether to apply charge sharing to the current line data by referring to whether charge sharing was applied to the previous line data and a comparison result between the power gain and the power loss when a display pattern is a dynamic pattern, and provide one of the first and second maximum variations, selected according to whether charge sharing was applied to the previous line data, as first option information when the display pattern is a static pattern.

12. The low power driving system of claim 11, further comprising a packet formation unit configured to form a packet including display data and control data, wherein the packet formation unit applies the first or second option information to the control data, wherein the first option information is applied for a low power mode to reduce the amount of current for maintaining the source driver output for the current line data, and the second option information is applied for adaptive charge sharing to select charge sharing on the current line data.

13. The low power driving system of claim 11, wherein the operation unit selectively performs a first operation of calculating a data variation between the previous line data and the current line data, a second operation of calculating a power gain and power loss by charge sharing on the current line data, a third operation of calculating the power gain and the power loss, and a fourth calculation of detecting the first maximum variation of the source driver output in the case where charge sharing is applied to the current line data and the second maximum variation of the source driver output in the case where charge sharing is not applied to the current line data, wherein the operation unit sequentially performs the first to third operations in response to the dynamic pattern, or sequentially performs the first and fourth operations in response to the static pattern.

14. The timing controller of claim 11, wherein when the display pattern is the dynamic pattern, the option providing unit provides the second option information for turning off the charge sharing on the current line data in the case where charge sharing was not applied to the previous line data or the power gain is smaller than the power loss, and provides the second option information for turning on the charge sharing on the current line data in the case where charge sharing was applied to the previous line data and the power gain is larger than the power loss.

15. The timing controller of claim 11, wherein the option providing unit provides the first maximum variation as the first option information when charge sharing was applied to the previous line data, and provides the second maximum variation as the second option information when charge sharing was not applied to the previous line data.

* * * * *